US006073570A

United States Patent [19]

Stirtz

[11] Patent Number: 6,073,570

[45] Date of Patent: Jun. 13, 2000

[54] TROLLING PLATE ASSEMBLY

[76] Inventor: Ronald H. Stirtz, 1660 Lorane Hwy., Eugene, Oreg. 97405

[21] Appl. No.: 09/165,262

[22] Filed: Oct. 1, 1998

[51] Int. Cl.[7] ..... B63H 25/44

[52] U.S. Cl. ..... 114/145 A

[58] Field of Search ..... 114/145 R, 145 A

[56] References Cited

U.S. PATENT DOCUMENTS

| | | | |
|---|---|---|---|
| 2,984,203 | 5/1961 | Canning . | |
| 3,117,548 | 1/1964 | Rasmussen | 114/145 A |
| 3,136,280 | 6/1964 | Bergum . | |
| 3,209,716 | 10/1965 | Hartley . | |
| 3,965,838 | 6/1976 | Uht . | |
| 4,549,498 | 10/1985 | Meyer et al. . | |
| 5,005,507 | 4/1991 | Dyer . | |
| 5,711,241 | 1/1998 | Dyer . | |
| B1 3,965,838 | 10/1989 | Uht . | |

*Primary Examiner*—Sherman Basinger
*Attorney, Agent, or Firm*—Kolisch, Hartwell, Dickinson, McCormack & Heuser

[57] ABSTRACT

A trolling plate assembly is designed for mounting on a cavitation plate on an outboard motor so that a plate member can be suspended behind a motorized propeller to limit velocity of the boat. The trolling plate includes a base, and a plate member suspended from the base via lateral support bars. A release mechanism allows the plate to rotate to a non-trolling position when water pressure against the front face of the plate member exceeds a predetermined threshold. The release mechanism utilizes a ramp and roller structure. The ramp forms an angle relative to the plate member. The angle can be adjusted so that different amounts of force are required to cause rotation of the plate member past a trip-point toward the non-trolling position.

22 Claims, 5 Drawing Sheets

20
CC
44
40
28
22
26
24
65
AA
BB

20
C
44
40
28
22
26
24
65
A
B

TROLLING PLATE ASSEMBLY

FIELD OF THE INVENTION

The invention relates to trolling plates. In particular, the invention involves a mechanism for releasing a trolling plate reliably at an appropriate water pressure threshold so that the trolling plate is not damaged in the event that the trolling plate is left down when the boat accelerates substantially beyond a trolling velocity.

BACKGROUND OF THE INVENTION

A popular and effective way of fishing involves dragging a fishing line from the back of a boat at a slow, constant velocity. This technique is referred to as trolling. Often, the motor that is used on a boat is not capable of running constantly at a low enough speed to maintain the desired slow trolling velocity. Over the years, people have used a type of device referred to as a "trolling plate" to limit boat speed. A trolling plate typically employs a rigid plate suspended behind the propeller of the motor. The plate deflects a significant amount of the water stream generated by the propeller, thereby limiting the velocity of the boat.

A problem with trolling plates that has been worked on for many years is that sometimes the operator of the boat forgets that the plate is down. The operator then causes the propeller to accelerate without releasing the trolling plate. Consequently, the trolling plate may be bent or damaged. Some people have tried to design automatic release mechanisms for trolling plates. For example, U.S. Pat. No. 5,711,241 to Dyer uses a release mechanism that includes a pair of adjustably biased rollers on opposing sides of the plate for contacting notches in trolling plate ears. A significant problem with the Dyer trolling plate is that sometimes one side of the plate releases before the other side releases, causing the plate to twist and possibly break. U.S. Pat. No. 3,136,280 discloses a trolling plate that pivots to the horizontal position in response to water pressure above a certain threshold. One problem with the plate described in the '280 patent is that the spring force used to maintain the trolling position of the plate is difficult to tune or adjust for the particular motor or trolling application.

It is an object of the invention to provide a trolling plate that releases reliably when water pressure generated by a motorized propeller exceeds a predetermined threshold. Another object of the invention is for a trolling plate to be adjustable such that the release threshold can be altered to suit the particular motor and boat specifications.

SUMMARY OF THE INVENTION

A trolling plate assembly includes a base structure that is configured for mounting on a cavitation plate of an outboard motor. A plate member is pivotally connected to the base. The plate member has a front face directed toward the propeller of the motor when the plate is in a trolling position, substantially perpendicular to the direction of water output from the propeller. A release mechanism allows the plate member to rotate to a non-trolling, substantially horizontal position when water pressure against the front face of the plate member exceeds a predetermined threshold. In a preferred embodiment of the invention, the release mechanism utilizes a ramp and roller or bumper structure. The ramp and roller structure contact and move with respect to each other as the plate is pushed back and up by augmented water pressure from the propeller.

In a preferred design, the plate is connected to the base via a pair of lateral braces that are suspended below parallel relative to the base when the plate is in the trolling position. As the plate is pushed back, the lateral braces move toward parallel alignment with the base, thereby causing the plate to move upward.

The release threshold of the trolling plate is adjustable by altering the angle formed by the ramp relative to the plate. A detent device is provided for holding the plate in the non-trolling position when the motor is not being used to troll.

DESCRIPTION OF THE INVENTION

Figure 1:
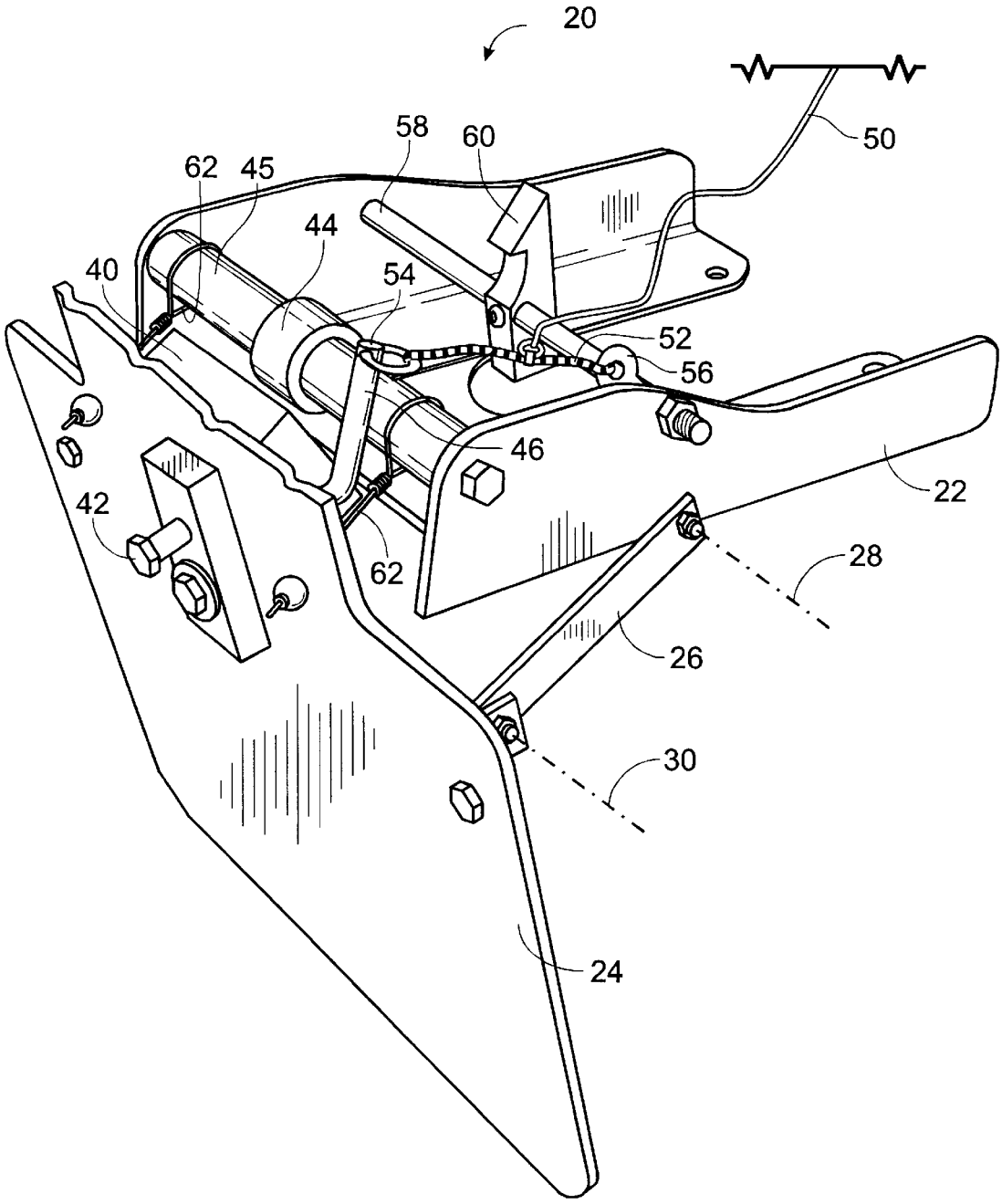
FIG. 1 is a perspective view of a trolling plate according to a preferred embodiment of the invention.

The invention provides a trolling plate design that releases reliably and automatically when water pressure generated by a propeller exceeds a selected threshold. FIG. 1 shows a perspective view of a trolling plate set in a substantially vertical orientation, referred to as the "trolling position". Trolling plate assembly 20 includes mounting bracket or base 22. Base 22 is configured for mounting on the cavitation plate of an outboard motor. Plate member 24 is pivotally connected to brace 22 via two lateral support bars 26, only one of which can be seen in FIG. 1. Lateral support bar 26 is pivotally connected to base 22 so that it can pivot around inside axis 28. At its other end, lateral support bar 26 is pivotally mounted to plate member 24 so that it is free to pivot around outside axis 30. Ramp 40 is mounted on the inside of plate member 24, intermediately between lateral support bars 26. A bolt or threaded member 42 is accessible from the back of plate member 24 and threads through plate member 24 to contact ramp 40. Adjustment of bolt 42 alters the angle of ramp 40 relative to plate member 24. Curved bumper member or roller 44 is mounted on cylinder 45 between the sides of base 22. Roller 44 is aligned with ramp 40 so that ramp 40 and bumper 44 contact and move (slide or roll) relative to each other when force is applied to the inside surface of plate member 24.

Rigid bar 46 extends obliquely upward from the upper inside surface of plate member 24. Lanyard 50 is connected to cable 52 which is linked to distal tip 54 of bar 46 and also to ring 56 which is affixed to axle 58. Detent 60 is secured near the center of axle 58 such that ring 56 and detent 60 rotate together with rotation of axle 58.

A pair of cables 62 connect cylinder 45 to plate member 24. Cables 62 prevent plate member 24 from being drawn into a propeller when the engine is placed in reverse.

Figure 2:
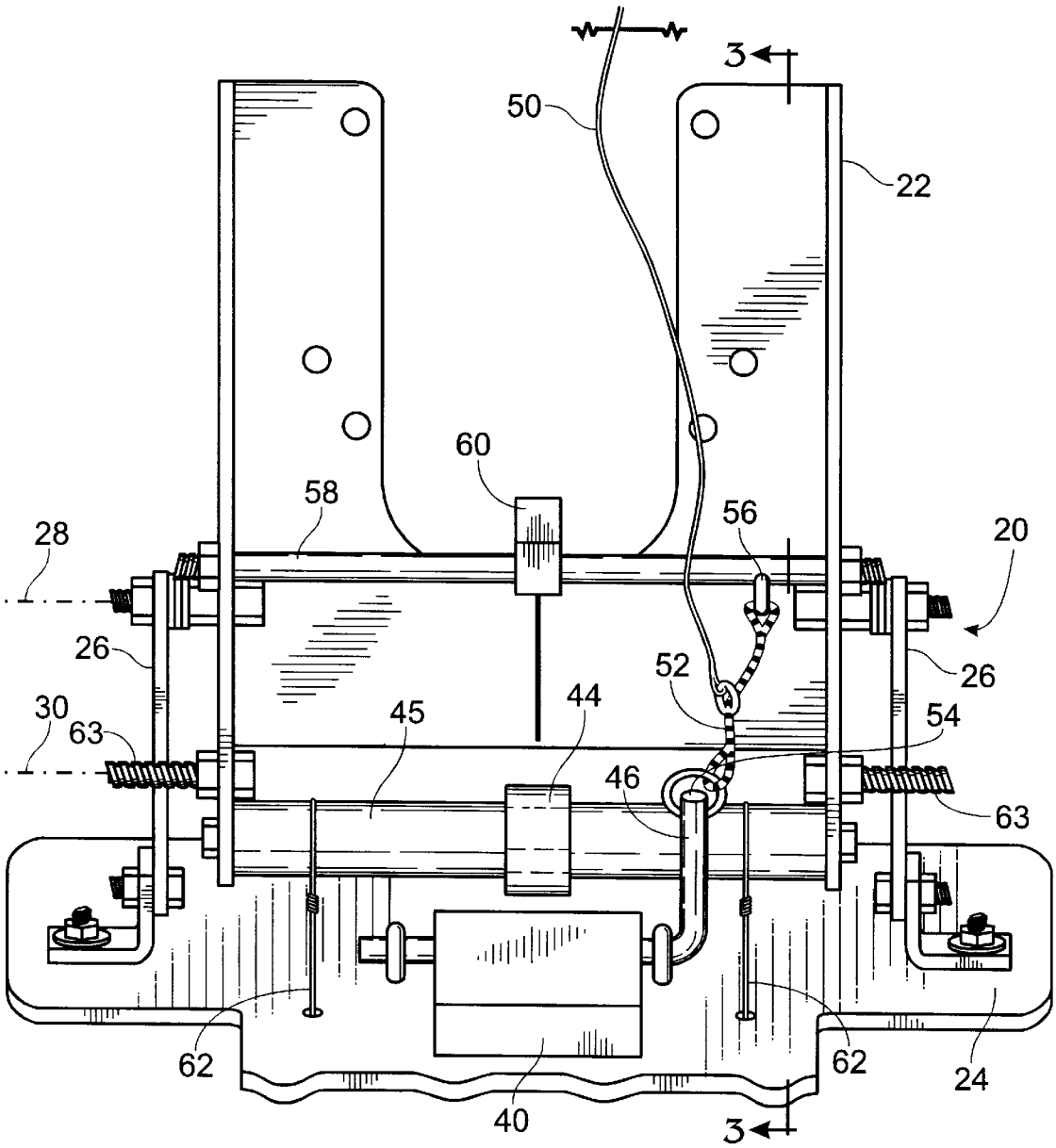
FIG. 2 is a top view of the trolling plate shown in FIG. 1.

FIG. 2 is a top view of trolling plate 20 of FIG. 1. Most of the details shown in FIG. 2 have already been discussed in reference to FIG. 1. Rigid extensions such as bolts 63 function as stops limiting upward movement of lateral support bars 26. In FIGS. 1 and 2, plate member 24 is positioned where it will be when there is no significant force being exerted on plate member 24 except for gravity, i.e., where plate member 24 is located when the motor is turned off. In this location, ramp 40 and roller 44 are not in contact. When the motor is placed in forward, ramp 40 moves into contact with roller 44.

An important feature of the invention is the mechanism which enables a person to alter or fine-tune the assembly so that it will release in response to a threshold amount of water pressure that suits the particular motor or trolling situation. When trolling with a large motor, the release setting is adjusted so that a relatively large amount of water pressure is required to push the plate member into the non-trolling position. This is because a large motor trolls at higher horsepower than a small motor. If the plate is set at a minimal release threshold, then water pressure generated by the large engine propeller at its trolling speed may cause the plate to rotate out of its trolling position at the wrong time. However, if the trolling plate is being used behind a small engine that is capable of trolling at significantly lower horsepower, then it is desirable to adjust the release setting so that the plate moves to its non-trolling position in response to a smaller amount of water pressure from the propeller.

Figure 4:
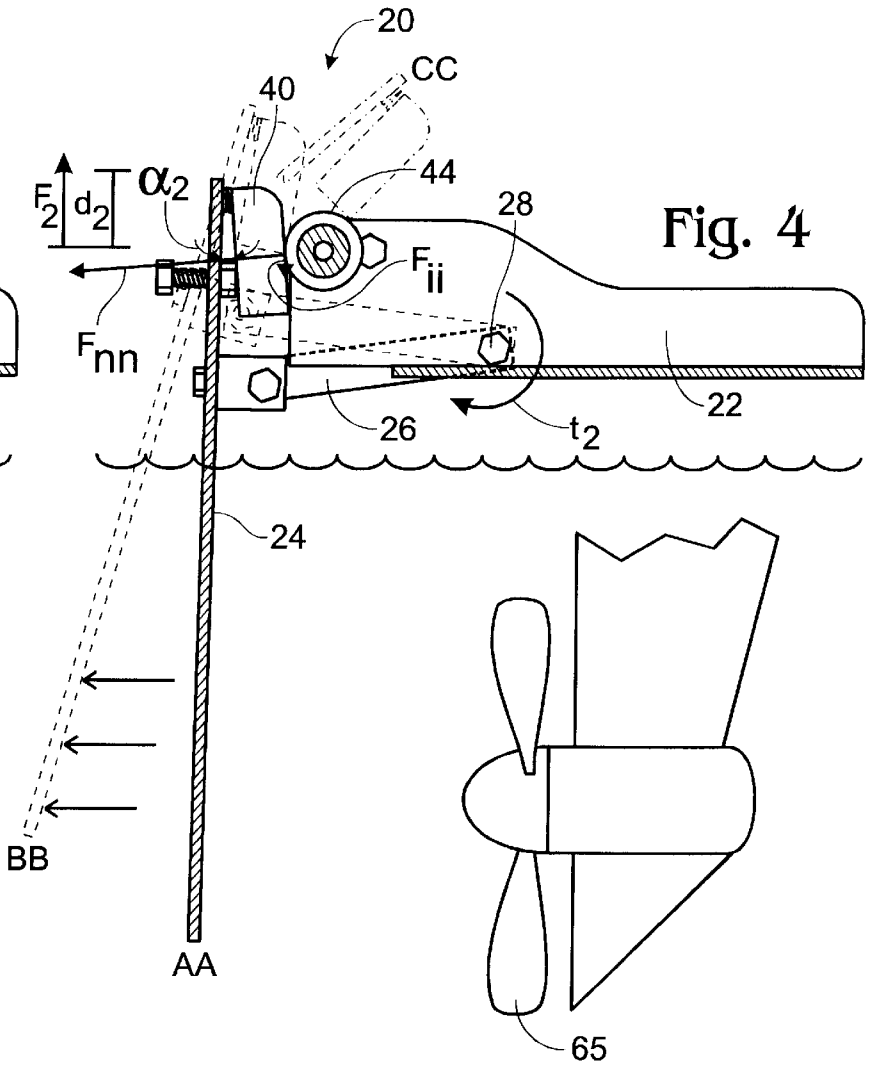
FIG. 4 is a side view similar to FIG. 3, except the angle of the ramp relative to the plate has been decreased so that it is easier to release the plate in response to water pressure from the propeller.
Figure 3:
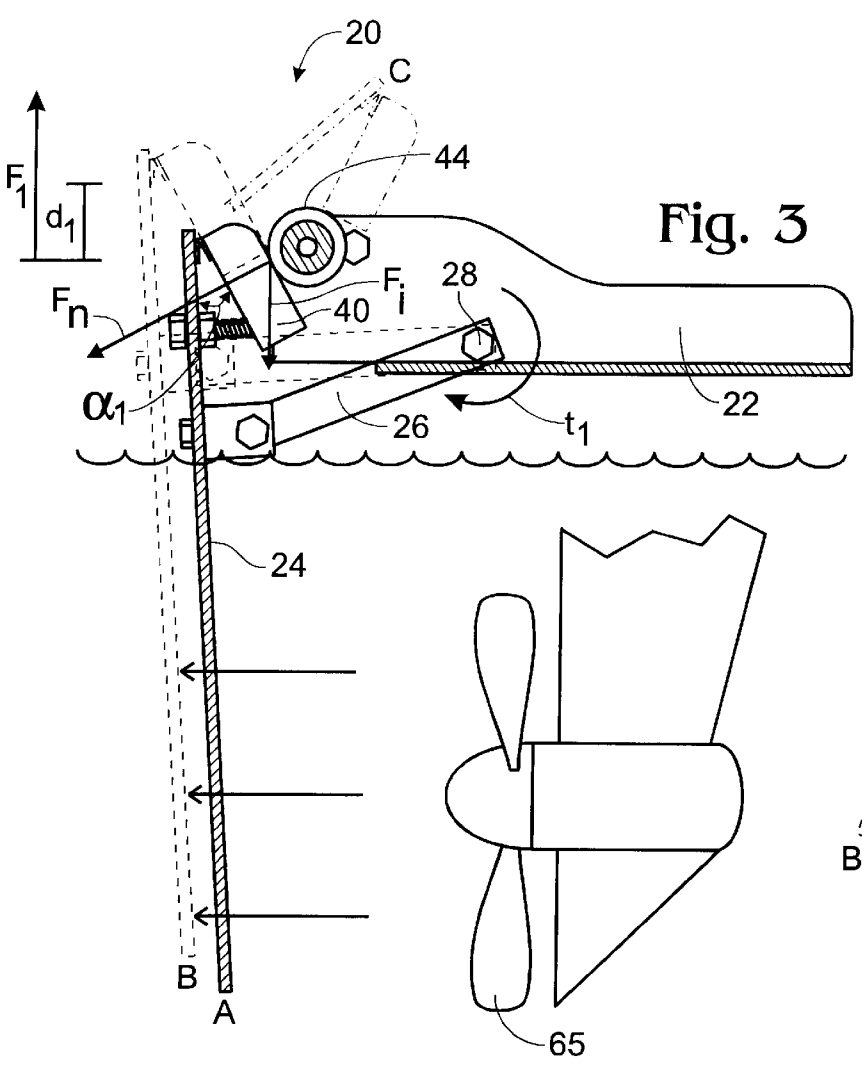
FIG. 3 is a side view of a trolling plate illustrating movement of the plate in response to water output from a propeller.

FIGS. 3 and 4 show the trolling plate responding to different amounts of water pressure at two different ramp angles relative to plate member 24. Force vectors in FIGS. 3 and 4 are not drawn to scale, but are used to illustrate relative differences in the function of trolling plate assembly 20 at different settings.

In each of FIGS. 3 and 4, ramp 40 and plate member 24 are shown in three different positions rotating around roller 44 in response to water pressure generated by propeller 65. In FIGS. 3 and 4, positions A and AA, shown in solid lines, are trolling positions for two different ramp settings. Positions B and BB, drawn in dashed lines, show plate member 24 and ramp 40, moved upward relative to roller 44, at or near the trip-point. Positions C and CC, shown in dash-dot lines, show locations of ramp 40 and plate member 24 after passing the trip-point, rotating toward the substantially horizontal non-trolling position.

In FIG. 3 trolling plate assembly 20 is adjusted for use behind a large outboard motor. Ramp 40 forms angle $\alpha_1$ with plate member 24. Propeller 65 generates water pressure against plate member 24 causing clock-wise torque $t_1$ on lateral support bar 26 around axis 28. Plate member 24 moves upward relative to base 22 because the only way for plate member 24 to gain any distance from propeller 65 is to move upward along with clock-wise rotation of support bar 26 toward parallel orientation with base 22. As bar 26 approaches parallel, progressively more force is required to move plate member 24 upward. Angled ramp 40 substantially impedes or counter-forces against upward movement of plate member 24 because roller 44 applies force $F_n$ normal to the surface of ramp 40. $F_n$ has a vertical force component $F_i$ that is directed downward countering or impeding upward movement of plate member 24. Consequently, a relatively large upward force F is required to elevate plate member 24 distance $d_1$ to the trip-point position B.

In contrast, as shown in FIG. 4, a relatively small angle $\alpha_2$ is formed between ramp 40 and plate member 24. The small magnitude of angle $\alpha_2$ causes ramp 40 to be less of an impedance or counter-force against upward movement of plate member 24. Roller 44 exerts force $F_{nn}$ normal to the surface of ramp 40. $F_{nn}$ has a downward vertical force component $F_{ii}$ which is much smaller than Fi in FIG. 3. When propeller 65 speeds up substantially above its trolling speed, water pressure exerted against the inside surface of plate member 24 causes torque $t_2$ on lateral support bar 26 around axis 28. Since ramp 40 is minimally angled to provide less impedance ($F_{ii}$) against upward movement of plate member 24, a relatively small amount of upward force $F_2$ is required to move plate member 24 upward by distance $d_2$ to the trip-point position BB.

Figure 5:
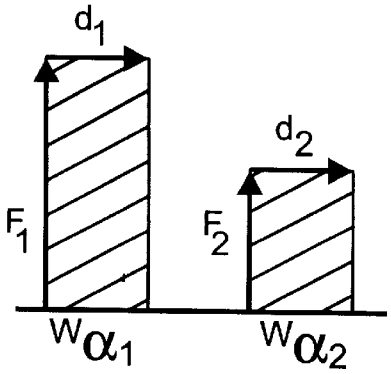
FIG. 5 is a bar graph showing relative amounts of work required to move the plate member to the trip-point in the configurations shown in FIGS. 3 and 4.

$F_1$ in FIG. 3 is substantially greater than $F_2$ in FIG. 4, while $d_1$ and $d_2$ are approximately equal. FIG. 5 shows a bar graph illustrating the relative amounts of work ($W_{\alpha 1}=F_1 \times d_1$, $W_{\alpha 2}=F_2 \times d_2$) required to push plate member 24 to trip-point positions B and BB, respectively, depending on the angles ($\alpha_1$ and $\alpha_2$) formed between ramp 40 and plate member 24.

Figure 6:
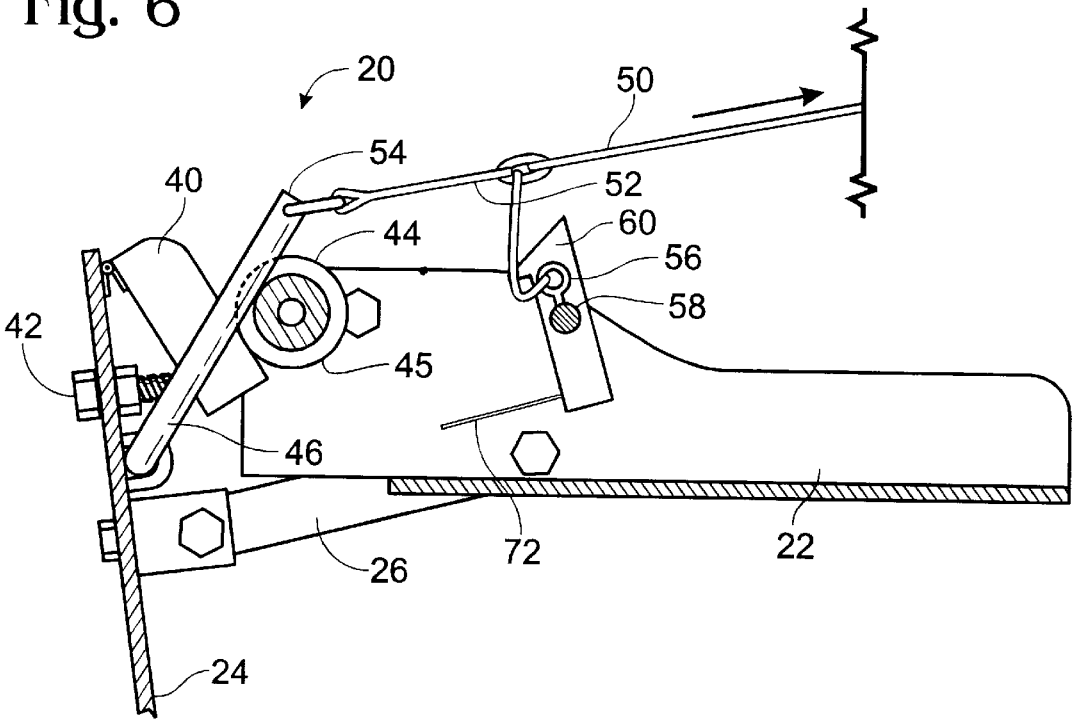
FIGS. 6 and 7 are a progression series of side views showing use of the lanyard to release and pull manually the trolling plate toward the non-trolling position.
Figure 7:
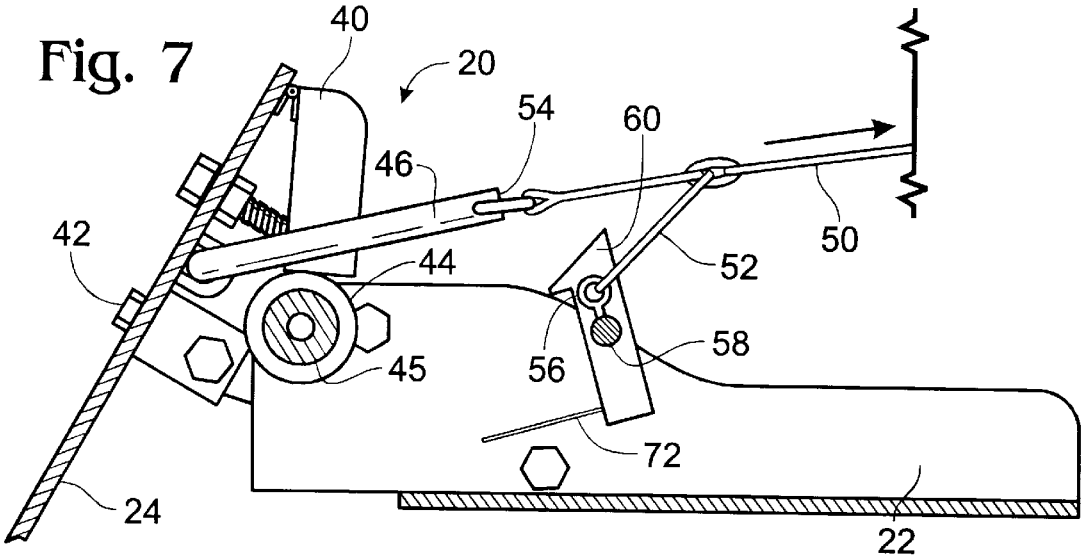

FIGS. 6 and 7 illustrate use of lanyard 50 to pull plate member 24 up from its trolling position. Once plate member 24 is pulled to the trip-point, then water pressure causes plate member 24 to complete rotation around roller 44 to the non-trolling position. As shown in FIG. 6, bar 46 is connected to the inside surface of plate member 24, and rests on cylinder 45. Cable 52 is connected to distal tip 54 of bar 46. A person in the boat can pull on lanyard 50, causing bar 46 to act as a lever on fulcrum cylinder 45, thereby pulling plate member 24 up and over the trip-point, as shown in FIG. 7.

Figure 8:
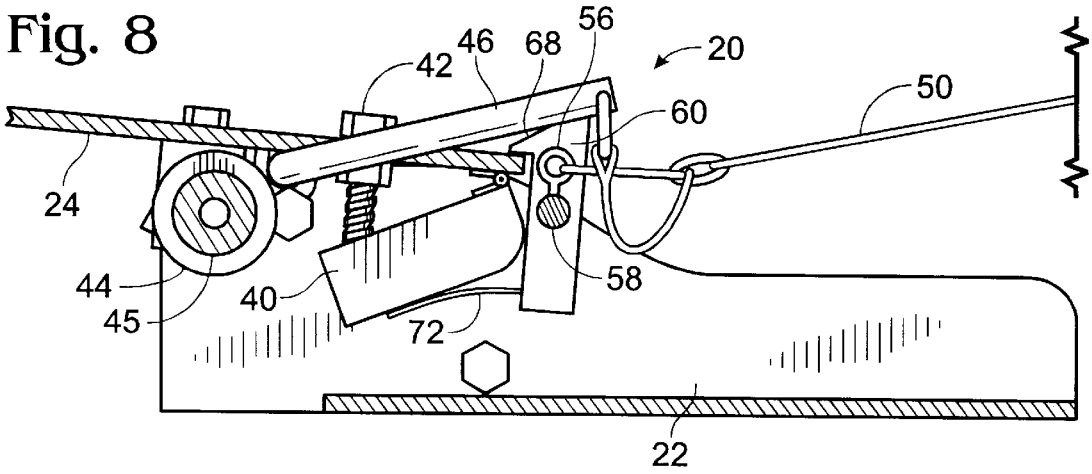
FIG. 8 is a side view of a trolling plate in the non-trolling position, being held in place by a detent device.
Figure 9:
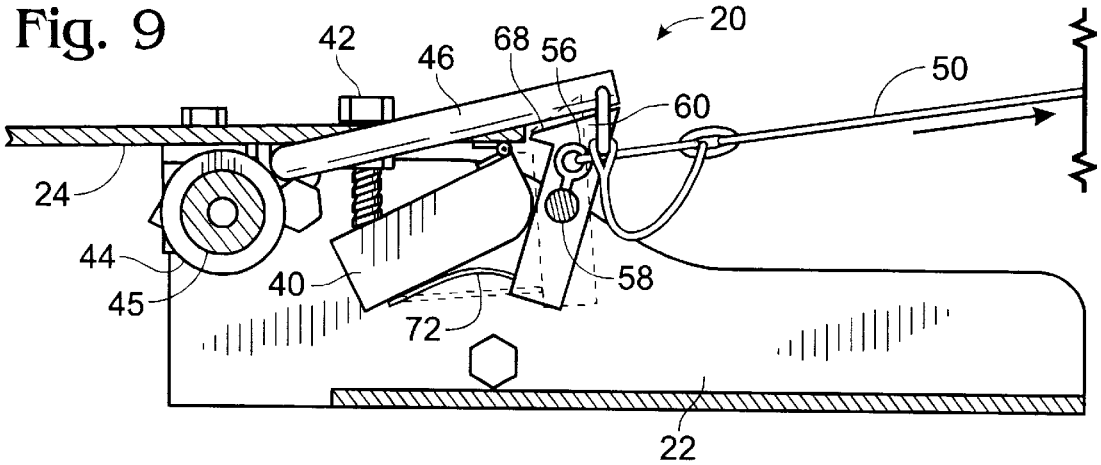
FIG. 9 is a side view of the trolling plate with the lanyard being pulled to disengage the detent device.

FIGS. 8 and 9 show how detent 60 secures plate member 24 in its non-trolling position, and how lanyard 50 can be pulled on to cause release of the detent securing mechanism. In FIG. 8, plate member 24 has rotated to an approximately horizontal position in which protrusion 68 of detent 60 hooks over plate member 24, thus holding plate member 24 in its non-trolling position. Detent 60 is urged forward to engage plate member 24, by spring 72 which is contacted and bent by ramp 40. Spring 72 is anchored to a lower portion of detent 60.

As shown in FIG. 9, a person can tug on lanyard 50, thereby causing clock-wise rotation of axle 58 and detent 60. When plate member 24 is unhitched by detent 60, it rotates counter-clock-wise, primarily under gravitational force, toward the trolling position.

Preferred embodiments of the invention have been illustrated and described in detail. However, it is apparent that many modifications of the invention are also possible. For example, the positions of the ramp and roller can be switched. The ramp can be connected to the base of the trolling plate assembly, while the roller is connected to the plate member.

There are also other ways to make the trolling plate assembly adjustable for different motor sizes. For example, the ramp angle can be permanently fixed, while the orientation of the lateral support bars can be adjustable. The connection points between the lateral support bars and the plate member can be adjustable vertically. Alternatively, the connection points between the lateral support bars and the base can be adjustable horizontally.

Further, the vertical position of either the ramp or the roller could be adjusted to cause the trip-point to be reached sooner or later in the plate's rotation. Moving the roller down in the configuration shown in FIG. 3 would cause the plate member to trip more quickly, thus serving a smaller motor. Conversely, moving the roller up would require the motor to drive the plate further up (and the lateral support bars to a more horizontal position) before tripping, hence serving a larger motor.

I claim:

1. A trolling plate assembly comprising a base configured for mounting behind a boat, a plate member pivotally connected to the base, the plate member having a front face directed toward a motorized propeller when the plate member is in a trolling position, and a release mechanism that allows the plate member to rotate to a non-trolling position when water pressure against the front face of the plate member exceeds a selected threshold, wherein the release mechanism includes a ramp and bumper structure that contact and move with respect to each other as the plate member moves between the trolling position and the non-trolling position, the plate member being connected to the base via a pair of lateral support bars, each support bar forming an acute angle with the base so that the angle decreases as the plate member is forced further away from the propeller.

2. The assembly of claim 1, wherein the ramp is connected to the plate member and the bumper structure is connected to the base.

3. The assembly of claim 1, wherein the ramp forms an angle relative to the plate member, the angle being adjustable to alter the amount of work required to slide the ramp relative to the bumper structure.

4. The assembly of claim 1, wherein the plate member pivots upward in response to water pressure exerted against the front face of the plate member.

5. The assembly of claim 1 further comprising a handle mechanism that enables manual movement of the plate member past a trip-point so that the plate member can be pushed to its non-trolling position by water pressure generated by the propeller.

6. The assembly of claim 1 further comprising a detent device for holding the plate member in the non-trolling position.

7. The assembly of claim 6 further comprising a spring that urges the detent device into engagement with an edge of the plate member.

8. The assembly of claim 7, wherein the spring is a substantially straight piece of flexible metal that is anchored to the detent device.

9. The assembly of claim 1, wherein the bumper structure includes a roller which rolls on the ramp when the plate member is moving between the trolling position and the non-trolling position.

10. The assembly of claim 1 further comprising a catch device that limits the plate member's degree of movement toward an engine when the engine is placed in reverse.

11. A trolling plate assembly comprising a base configured for mounting behind a boat, a plate member pivotally connected to the base, the plate member having a front face directed toward a motorized propeller when the plate member is in a trolling position, and a release mechanism that allows the plate member to rotate around two parallel axes to a non-trolling position when water pressure against the front face of the plate member exceeds a selected threshold, the release mechanism including a ramp surface forming a pre-set angle relative to the plate member, wherein the release mechanism exerts a resistive force against upward movement of the plate member, the resistive force being a function of the pre-set angle of the ramp surface.

12. The assembly of claim 11, wherein the plate member is connected to the base via a pair of lateral support bars.

13. The assembly of claim 12, wherein each support bar forms an acute angle with the base so that the angle decreases as the plate member is forced further away from the propeller.

14. A trolling plate assembly comprising a base configured for mounting behind a boat, a plate member pivotally connected to the base via a pair of lateral support bars, the plate member having a front face directed toward a motorized propeller when the plate member is in a trolling position, the support bars being positioned so that they rotate toward parallel alignment with the base when sufficient water pressure is applied to the front face of the plate member, and a release mechanism that allows the plate member to rotate to a non-trolling position when water pressure against the front face of the plate member exceeds a selected threshold, the release mechanism including a ramp and bumper structure that slide with respect to each other as the plate member moves between the trolling position and the non-trolling position.

15. The assembly of claim 14, wherein progressively more force is required to move the plate member upward as the support bars approach parallel alignment with the base.

16. The assembly of claim 14 further comprising an adjustment mechanism that allows alteration of the angle formed between the lateral support bars and the base when the plate member is in the trolling position.

17. The assembly of claim 14, wherein the ramp forms an angle relative to the plate, the angle being determinative of the amount of work required to force the plate member from the trolling position to the non-trolling position.

18. The assembly of claim 17, wherein the angle formed between the ramp and the plate member is adjustable.

19. A trolling plate assembly comprising a base configured for mounting behind a boat, a plate member having a front face directed toward a motorized propeller when the plate member is in a trolling position, the plate member being suspended from the base in a manner so that it rotates around two parallel axes in response to pressure exerted on the front face of the plate member, a release mechanism that allows the plate member to rotate to a non-trolling position when water pressure against the front face of the plate member exceeds a selected threshold and wherein a plane which is parallel to the front face of the plate member in the trolling position is divergent with respect to a plane which is parallel to the front face of the plate member in the non-trolling position.

20. The assembly of claim 19, wherein the plate member is connected to the base via a pair of lateral support bars, each support bar having a first end pivotally connected to the base and an opposite second end pivotally connected to the plate member, a first axis of rotation being defined between the first ends of the lateral support bars, and a second rotational axis being defined between the second ends of the lateral support bars.

21. A method of releasing a trolling plate from directly confronting water pressure generated from a motorized propeller comprising selecting an angle to be formed by a ramp surface and the trolling plate, and adjusting the angle formed by the ramp and the trolling plate to alter the amount of work required to slide the ramp surface relative to a bumper surface, sliding the ramp surface relative to the bumper surface in response to water pressure exerted on the front surface of the plate, and permitting the plate to rotate to a non-trolling position substantially out of the way of water flow from the propeller when the bumper surface slides off the ramp surface.

22. A trolling plate assembly comprising a base configured for mounting behind a boat, a plate member pivotally connected to the base, the plate member having a front face directed toward a motorized propeller when the plate member is in a trolling position, and a release mechanism that allows the plate member to rotate to a non-trolling position when water pressure against the front face of the plate member exceeds a selected threshold, wherein the release mechanism includes a ramp and bumper structure that contact and move with respect to each other as the plate member moves between the trolling position and the non-trolling position, the ramp forming an angle relative to the plate member, the angle being adjustable to alter the amount of work required to slide the ramp relative to the bumper structure.

* * * * *